United States Patent [19]

Sangati

[11] Patent Number: 4,619,408

[45] Date of Patent: Oct. 28, 1986

[54] CONTROL SYSTEM FOR GRINDING MILL

[75] Inventor: Guido Sangati, Padua, Italy

[73] Assignee: Sangati S.p.A., Padua, Italy

[21] Appl. No.: 583,931

[22] Filed: Feb. 27, 1984

[30] Foreign Application Priority Data

Feb. 25, 1983 [IT] Italy ..... 19774 A/83

[51] Int. Cl.[4] ..... B02C 25/00

[52] U.S. Cl. ..... 241/34; 241/36; 241/37; 241/64; 241/143; 241/233

[58] Field of Search ..... 241/33, 34, 36, 37, 241/63, 64, 143, 144, 233; 73/304 C; 222/56, 64

[56] References Cited

U.S. PATENT DOCUMENTS 3,468,488 9/1969 Karrer et al. ..... 241/34
4,115,877 9/1978 Wall ..... 73/304 C X
4,169,543 10/1979 Hall ..... 73/304 C X
4,442,980 4/1984 Oetiker et al. ..... 241/34

*Primary Examiner*—Howard N. Goldberg
*Assistant Examiner*—Timothy V. Eley
*Attorney, Agent, or Firm*—Karl F. Ross; Herbert Dubno

[57] ABSTRACT

A mill for grinding farinaceous seeds into flour comprises a pair of counterrotating cylinders to which seeds to be ground are fed from a hopper with the aid of a transport roller driven by a variable-speed motor. A sensor inside the hopper measures, e.g. capacitively, the level of a supply of seeds present therein and controls the speed of that motor to vary the feed rate substantially in proportion to the measured level. When the sensor detects a drop of that level below a minimum threshold, it stops the transport roller and causes the cylinders to be separated from each other.

1 Claim, 3 Drawing Figures

CONTROL SYSTEM FOR GRINDING MILL

FIELD OF THE INVENTION

My present invention relates to a grinding mill designed to convert farinaceous seeds into flour.

BACKGROUND OF THE INVENTION

In conventional grinding mills the seeds or grains to be ground are loaded into a hopper from whose outlet they are extracted by a transport roller and/or a feed-screw for delivery to the nip of two counterrotating main rolls or cylinders between which they are comminuted. On their way to these grinding cylinders the grains move through a narrow passage which is bounded on one side by a curved cover plate whose spacing from a fixed countersurface is controlled—e.g. hydraulically—by a seed-level detector such as a float located in the hopper. Since the reloading of the hopper generally takes place only at intervals, the level of the granular mass therein is subjected to considerable variations and may, in fact, go to zero when the contents of the hopper are depleted. In such a case, the detector should separate the two counterrotating cylinders from each other in order to prevent them from coming into direct grinding contact; at the same time, the detector arrests the transport roller and moves the cover plate onto the countersurface in order to block the passage of grain therethrough until the hopper has been refilled whereupon the cylinders can be restored to their operating position.

In order to let the mill operate as efficiently as possible with changing loads, the detector may also cause a shifting of the cover plate during normal operating so as to vary the width of the passage in a manner generally proportional to the seed level in the hopper. This is meant to maintain a substantially constant density of the mass to be ground.

Such a change of the width of the granular flow reaching the grinding cylinders, however, may bring about significant variations in the granulometry and thus in the chemical and physical characteristics of the product. This reflects on the overall quality of the flour and is therefore objectionable.

OBJECT OF THE INVENTION

The object of my present invention, accordingly, is to provide means for controlling the operation of a grinding mill in a manner maintaining its adaptability to different loads while obviating the drawback just mentioned.

SUMMARY OF THE INVENTION

I have found, in conformity with my present invention, that this object can be realized by making the speed of the transport roller variable under the control of the level detector in the hopper without modifying the width of a passage through which the grains must move on their way to the grinding cylinders. Thus, the width of the mass flow remains constant and only the flow rate is being changed in a manner proportional to the seed level.

Advantageously, the transport roller of variable velocity lies in cascade with a distributing roller corotating therewith at substantially the same peripheral speed in guiding the oncoming grains to the grinding cylinders.

I further prefer to control the roller speed by a detector designed as a capacitive level sensor rather than a mechanical float. Such a sensor is able to measure level variations with great accuracy and is eminently suitable to determine also the threshold at which the transport roller must be arrested and the grinding cylinders are to be separated.

BRIEF DESCRIPTION OF THE DRAWING

The above and other features of my present invention will now be described in detail with reference to the accompanying drawing in which.

SPECIFIC DESCRIPTION

Figure 1:
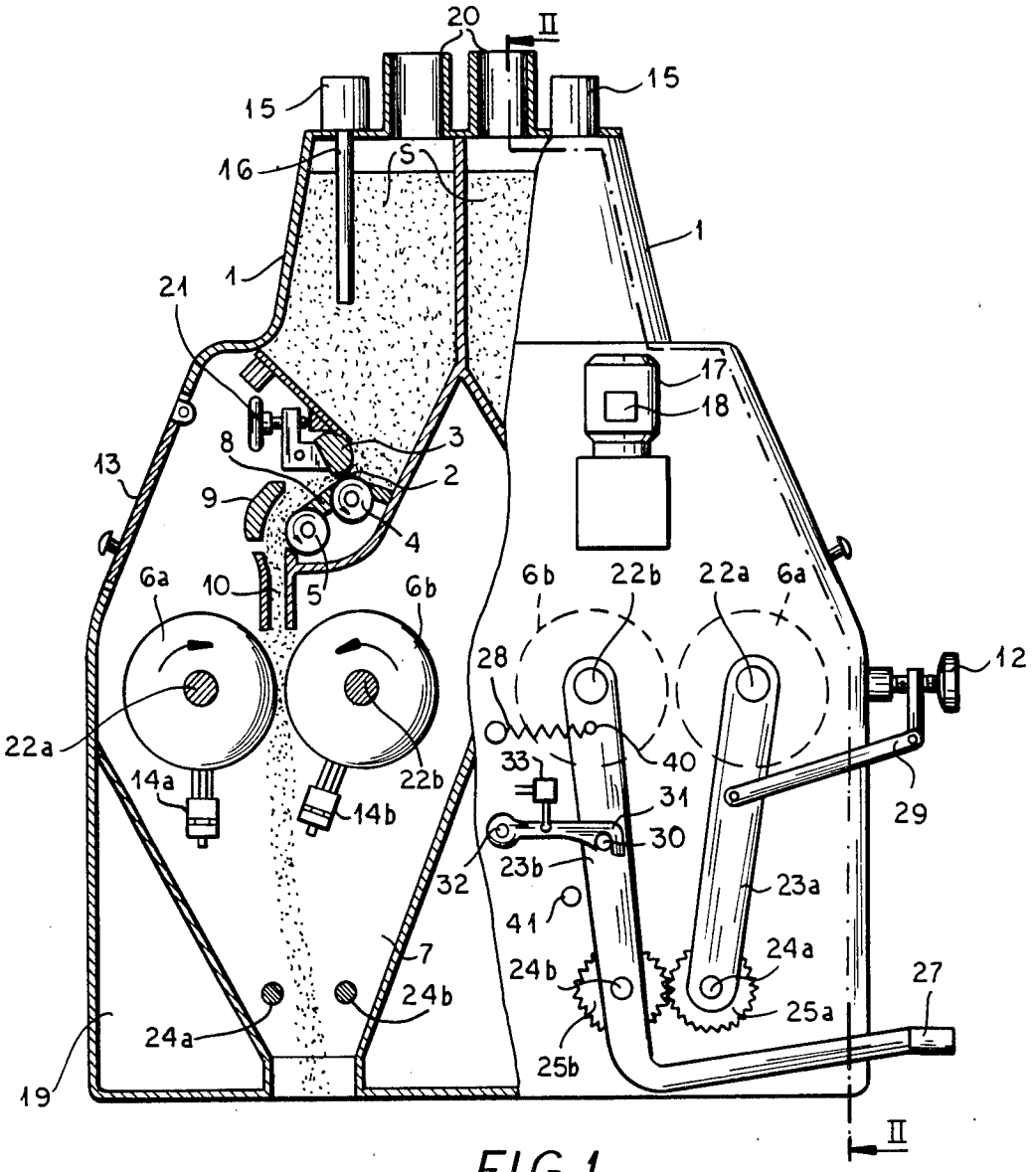
FIG. 1 is an elevational view, with parts broken away, of a grinding mill embodying a control system according to my invention.
Figure 2:
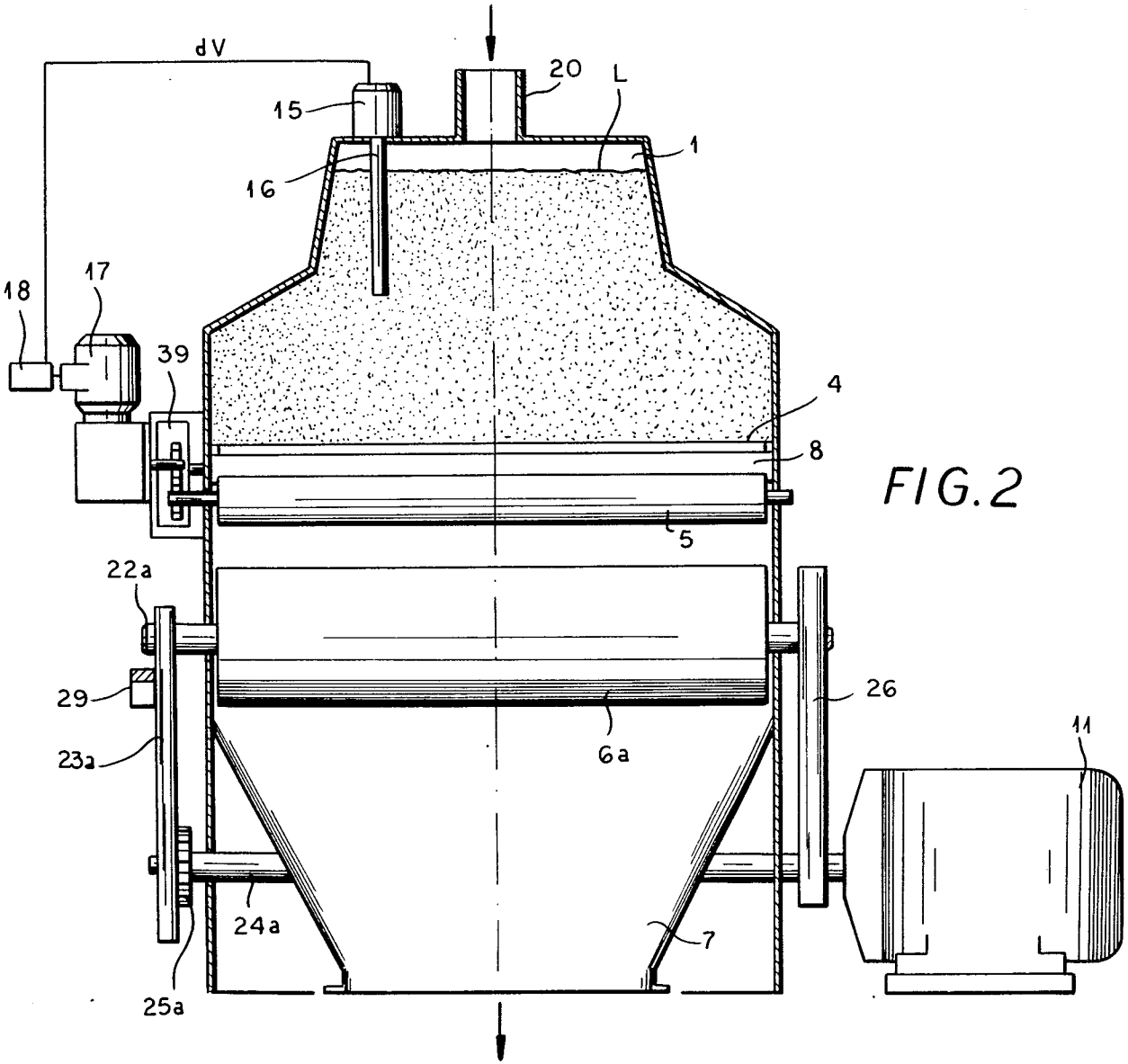
FIG. 2 is a cross-sectional view taken on the line II—II of FIG. 1.

The grinding mill shown in FIGS. 1 and 2 is divided into two symmetrical halves of identical structure so that only one of the duplicated components needs to be described in each instance. These components include, for each half, a hopper 1 loadable through an inlet 20 and provided with an outlet gap 2 bounded by a manually adjustable bar 3 and by a normally rotating transport roller 4. A guide plate 8 directs seeds S to be ground, loaded into hopper 1, into a somewhat wider passage bounded by a stationary deflector 9 and by a distributing roller 5 corotating counterclockwise in the left-hand half of FIG. 1 with roller 4 at substantially the same, possibly slightly higher peripheral speed. Roller 5 feeds the oncoming seeds into a channel 10 terminating at the nip of a pair of counter-rotating grinding cylinders 6*a*, 6*b* by which they are comminuted and delivered as flour to an outlet of a discharge funnel 7.

The compartment containing rollers 4, 5 and grinding cylinders 6*a*, 6*b* is accessible through a door 13 enabling the position of bar 3 to be adjusted with the aid of a handwheel 21. The two cylinders are continuously scraped by brushes 14*a*, 14*b*.

Cylinders 6*a*, 6*b* are keyed to respective shafts 22*a*, 22*b* whose opposite extremities are journaled in the free upper ends of two pairs of arms 23*a*, 23*b* which are swingable at their lower ends about another pair of shafts 24*a*, 24*b*. Shaft 24*a*, driven by a motor 11, carries a gear 25*a* in mesh with another gear 25*b* on companion shaft 24*b* whereby the two shafts counterrotate; each shaft is connected through a respective chain or belt transmission 26 (only one shown) with the associated cylinder shaft 22*a*, 22*b* for entraining same.

Arm 23*b* is integral with a pedal 27 enabling it to be swung clockwise about its pivot shaft 24*b* against the force of a spring 28 which is anchored thereto at 40 and tends to separate the cylinder 6*b* from cylinder 6*a*; the position of the latter is manually adjustable by a handwheel 12 connected by a link 29 with arm 23*a*. A detent 30 on arm 23*b* coacts with a latch 31, swingable about a pivot 32, in order to arrest the arm 23*b* in a position in which cylinder 6*b* approaches cylinder 6*a* to the extent determined by the setting of handwheel 12. Arm 23*b* can be unlatched by a nornally de-energized solenoid 33.

Figure 3:
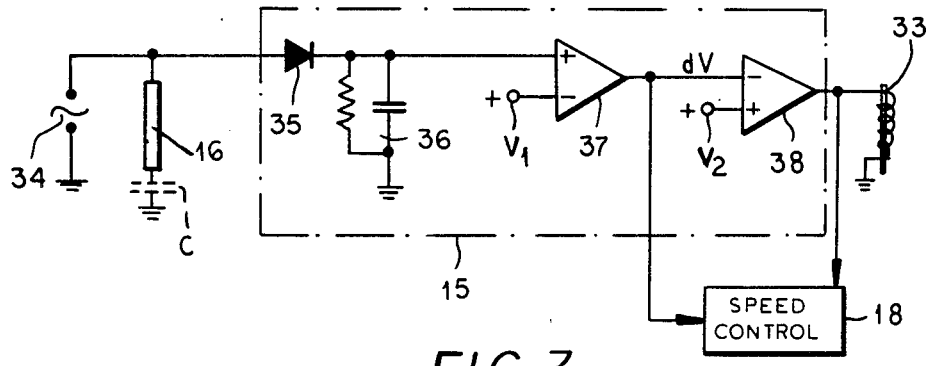
FIG. 3 is a diagram of the electric circuitry of the control system.

In accordance with my present invention, each hopper 1 is provided with a detector 15 provided with a sensor 16 which projects from above into the mass of seeds or grains S for capacitively determining the location of seed level L. Sensor 16 may comprise two parallel rods, spaced apart within the hopper, or—as here represented—a single rod forming a variable capacitance (schematically indicated at C in FIG. 3) with the surrounding metallic housing, assumed to be grounded. For this purpose the detector is connected to a source 34 of alternating current, also indicated in FIG. 3, designed to build up an alternating potential across the measured capacitance C whose magnitude depends on the seed level L. A diode 35 inside the detector rectifies this potential and feeds it to an integrator 36 from which it is supplied to an additive input of a comparator 37 having a fixed reference voltage $V_1$ applied to its subtractive input. The resulting difference voltage dV is delivered to a control unit 18 which, in a manner known per se, varies the operating speed of a motor 17 energized by a-c source 34 (or by some other source) to drive the transport roller 4 and the associated distributing roller 5. These two rollers are coupled with motor 17 through a gear transmission 39. The electrical components of FIG. 3, other than sensing rod 16, could be located in a space 19 adjoining the discharge funnel 7.

Another comparator 38 in detector 15 receives the difference voltage dV from comparator 37 on its subtractive input and has its additive input connected to a point of fixed threshold voltage $V_2$. When voltage dV drops below the threshold value $V_2$, indicating the supply of seeds in hopper 1 has fallen below a predetermined minimum level (specifically the one defined by the lower end of sensing rod 16 beyond which there is no further change in capacitance C), comparator 38 energizes the solenoid 33 and causes control unit 18 to stop the operation of motor 17. The lifting of latch 31 (FIG. 1) by solenoid 33 lets the spring 28 swing the cylinder **6*b* away from its mate 6*a* until the arm 23*b* abuts a stop 41. After the hopper has been refilled, the operator may restart the motor 17 and restore the working position of the cylinders by stepping on the pedal 27**.

I claim:

1. In a grinding mill for converting farinaceous seeds into flour, including a metal hopper having an inlet at an upper end for receiving seeds to be ground, a pair of counterrotating cylinders for comminuting said seeds, and a transport roller disposed at an outlet of said hopper for extracting the seeds therefrom and delivering same to said cylinders, the combination therewith of:

a variable-speed drive motor coupled with said transport roller;

a continuous-output capacitive sensor having a cylindrical head mounted on said upper end and a uniform-diameter cylindrical rod depending from said head adjacent said inlet but in all around spacing from walls of said hopper and extending into seeds in said hopper for continuously determining the seed level therein and producing an analog signal representing said seed level;

means for grounding said hopper;

analog circuit means connected between said sensor and ground for controlling said motor to vary the speed of said transport roller continuously in a manner generally proportional to said seed level in response to said signal; and a distributing roller interposed between said transport roller and said cylinders and coupled with said transport roller for rotating therewith at substantially the same peripheral speed, said cylinders being provided with a servomechanism controlled by said detector means for separating said cylinders from each other upon said seed level dropping below a predetermined threshold.

* * * * *